US006857378B2

(12) United States Patent
Franze et al.

(10) Patent No.: US 6,857,378 B2
(45) Date of Patent: Feb. 22, 2005

(54) TABLE WITH ADJUSTABLE SUPPORT

(75) Inventors: Patrick L. Franze, Atwater, OH (US); Donald L. Franze, Atwater, OH (US); Russ Goodman, Louisville, OH (US)

(73) Assignee: Randolph Tool Co., Inc., Hartville, OH (US)

( * ) Notice: Subject to any disclaimer, the term of this patent is extended or adjusted under 35 U.S.C. 154(b) by 57 days.

(21) Appl. No.: 10/261,513

(22) Filed: Sep. 30, 2002

(65) Prior Publication Data

US 2004/0060486 A1 Apr. 1, 2004

(51) Int. Cl.[7] ..... A47B 9/20
(52) U.S. Cl. ..... 108/147.19; 248/408; 108/146
(58) Field of Search ..... 248/408, 407, 248/129, 412, 188.5; 108/147.19, 147.21, 146, 147, 150, 49; 297/344.18, 423.25

(56) References Cited

U.S. PATENT DOCUMENTS 431,803 A * 7/1890 Cunningham et al. ..... 248/408
1,114,896 A * 10/1914 MacRae ..... 248/408
2,087,932 A * 7/1937 Zola et al. ..... 297/241
2,353,064 A * 7/1944 Parham ..... 108/1
2,605,987 A * 8/1952 Brown et al. ..... 248/408
2,685,487 A * 8/1954 Woller ..... 108/146
3,443,784 A * 5/1969 Walkinshaw ..... 248/408
3,854,428 A * 12/1974 Fullenkamp ..... 108/146
4,119,044 A * 10/1978 Hines ..... 108/27
4,289,292 A * 9/1981 Kunjumon ..... 248/333
4,807,836 A * 2/1989 Price et al. ..... 248/123.11
5,615,620 A * 4/1997 Owen ..... 108/45
6,240,856 B1 * 6/2001 Paskey et al. ..... 108/146

* cited by examiner

*Primary Examiner*—Janet M. Wilkens
(74) *Attorney, Agent, or Firm*—Zollinger & Burleson Ltd.

(57) ABSTRACT

A table has an adjustable support wherein the ratchet mechanism that locks the position of the tray with respect to the base may be moved to the unlocked position with the user's leg while the tray of the table is held by the user's hands. The table may also have a locking detent that extends entirely across the width of the support leg attached to the tray of the table to provide a strong, secure, and stable support when the table is used with heavy objects.

15 Claims, 10 Drawing Sheets

TABLE WITH ADJUSTABLE SUPPORT

BACKGROUND OF THE INVENTION

1. Technical Field

The present invention generally relates to adjustable tables and, more particularly, to tables having adjustable heights. Specifically, the present invention relates to a work table having an adjustable stand held in place with a ratchet mechanism that may be actuated by the foot of the user while the tray of the table is held by the user's hands.

2. Background Information

Various tables having adjustable heights are known in the art. Examples of such tables include those with adjustable feet or telescoping legs. There are many different adjustment mechanisms that are used to provide the height adjustment. Such mechanisms include threaded connections, ratchet mechanisms, pneumatic cylinders, and slide arrangements having various types of clamps or stops. All of these devices have advantages and drawbacks.

Those who use work tables that hold work pieces or tools desire tables having adjustable-height trays. Such tables are used in situations where heavy work pieces are supported by the table or where many hand tools are supported on the table. Table users in these situations desire stable tables that have secure latching mechanisms that will not allow the table to slip out of position while also allowing for hands-free operation of the latching mechanism.

BRIEF SUMMARY OF THE INVENTION

The present invention provides one embodiment of a table with an adjustable support wherein the ratchet mechanism that locks the position of the tray with respect to the base may be moved to the unlocked position with the user's leg while the tray of the table is held by the user's hands.

The invention also provides an embodiment of the table wherein the locking detent of the ratchet extends entirely across the width of the support leg attached to the tray of the table to provide a strong, secure, and stable support when the table is used with heavy objects.

The invention further provides an embodiment of the table wherein the handle of the ratchet extends downwardly from the handle pivot point such that the weight and geometry of the handle helps the ratchet automatically return to its locked position from the unlocked position.

BRIEF DESCRIPTION OF THE SEVERAL VIEWS OF THE DRAWINGS

Similar numbers refer to similar elements through the specification.

DETAILED DESCRIPTION OF THE INVENTION

Figure 1:
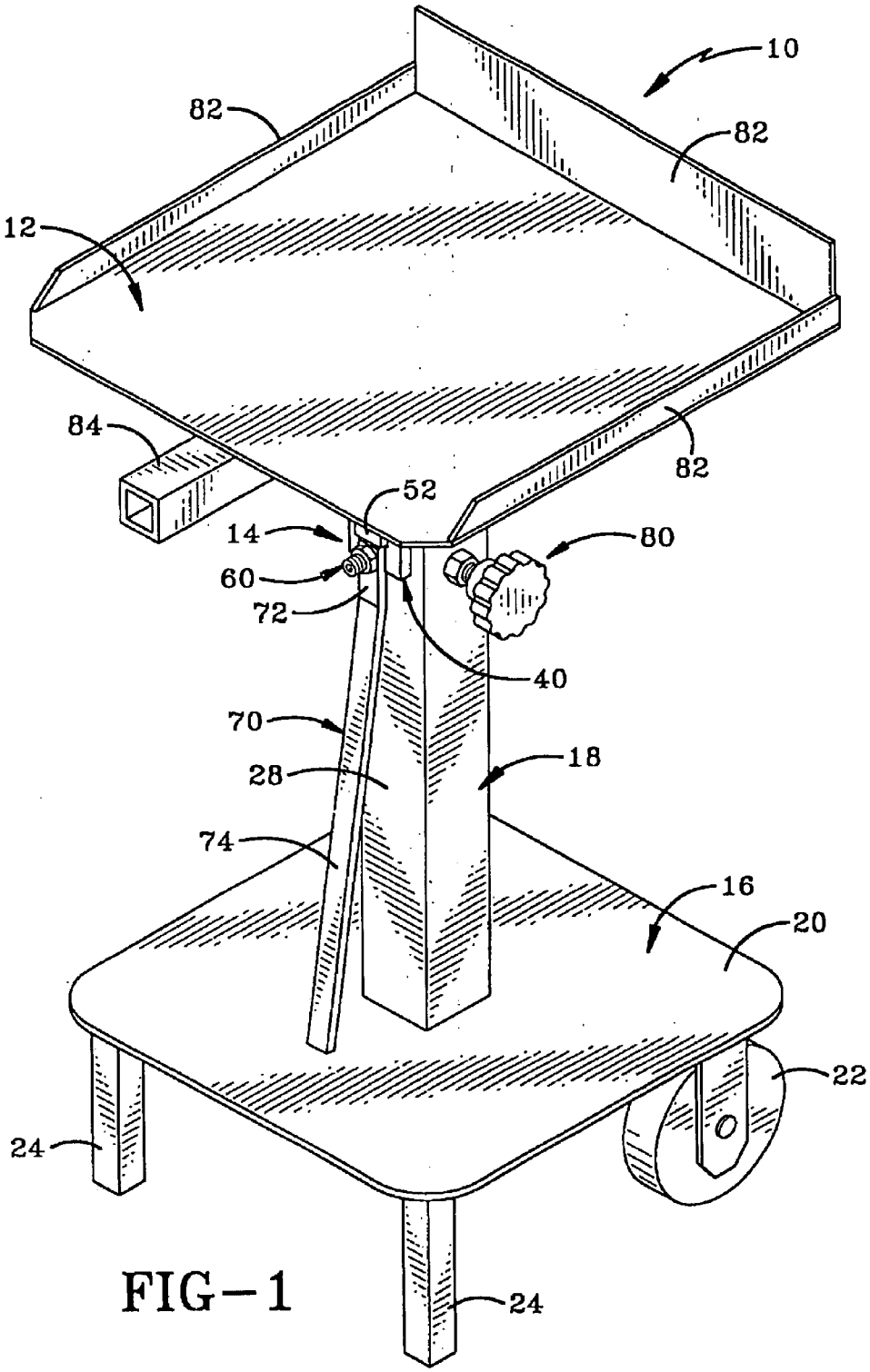
FIG. 1 is a perspective view of the table of the present invention.
Figure 2:
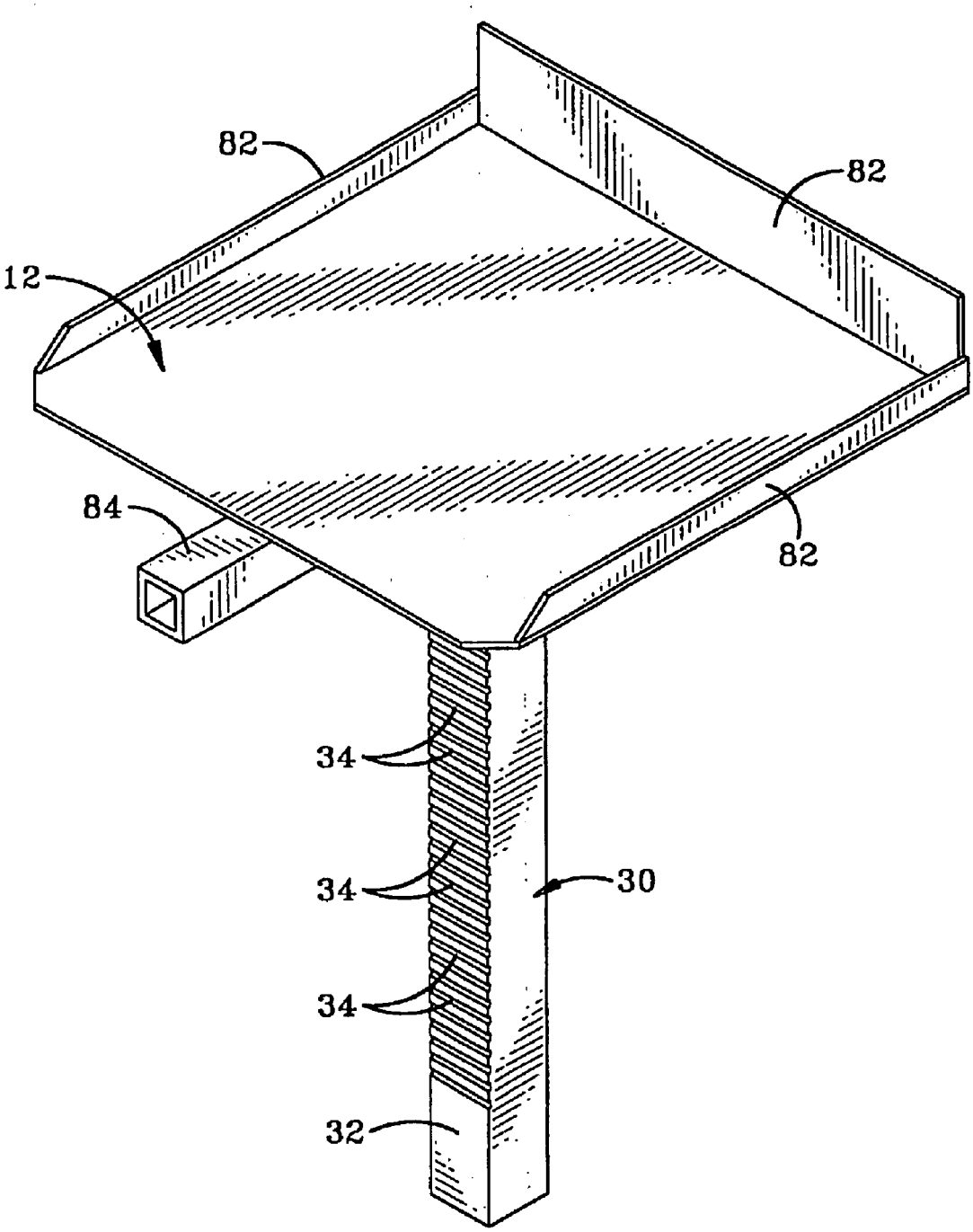
FIG. 2 is a perspective view of the tray and the support leg attached to the tray.
Figure 3:
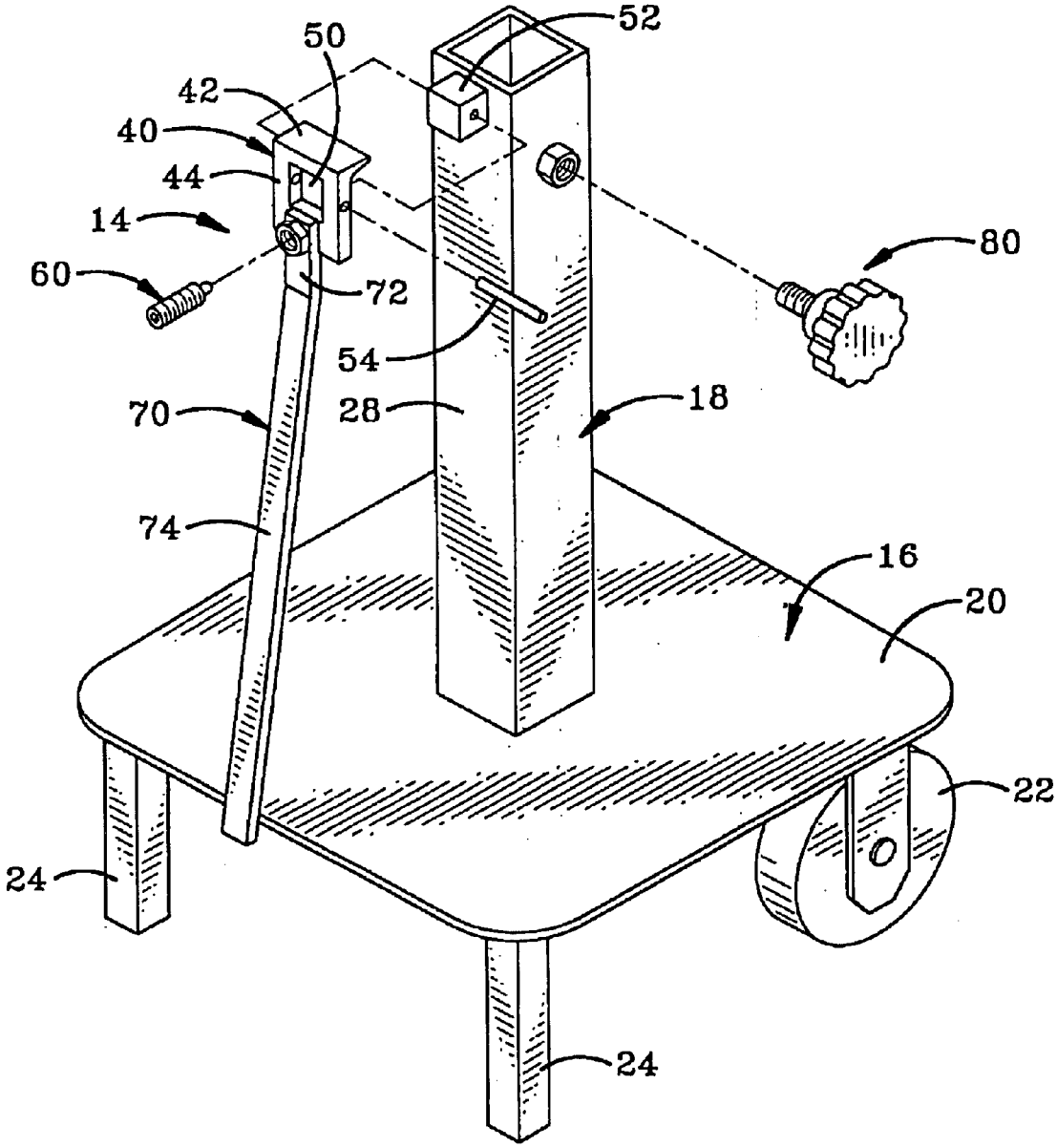
FIG. 3 is an exploded perspective view of the base and the support sleeve attached to the base.

The table of the present invention is indicated generally by the numeral 10 in the accompanying drawings. Table 10 has an adjustable height that allows the user to position table 10 in a comfortable and convenient position with respect to the user. Table 10 is configured to allow the user to hold the tray 12 of table 10 with both hands while making the height adjustment. Table 10 is further configured to allow the user to adjust the height of table 10 while standing next to table 10 instead of hunching down under table 10. The ratchet mechanism 14 that holds tray 12 in its adjusted position is configured to provide a strong, stable, and secure connection that allows table 10 to be used with heavy work pieces.

Table 10 generally includes a base 16 and a support sleeve 18 that extends up from base 16. In the exemplary embodiment of the invention depicted in the drawings, base 16 includes a base plate 20, a pair of wheels 22, and a pair of legs 24. In other embodiments of the invention, base 16 may simply include a plate, a foot, or a leg connected to sleeve 18. In another embodiment of the invention base 16 is simply the lower portion of sleeve 18 that is configured to engage the floor 26.

Support sleeve 18 may be provided in any of a wide variety of cross sections. One group includes those cross sections having at least one flat sidewall 28. At least a portion of sleeve 18 is hollow so that a portion of a support leg 30 may be slidably received within sleeve 18. Support leg 30 is connected to tray 12. Leg 30 has at least one flat sidewall 32. Leg 30 has a cross section that corresponds to the cross section of sleeve 18 so that leg 30 may not rotate when a portion of leg 30 is received in sleeve 18. In the exemplary embodiment of the invention, the cross sections are rectangular or square. In other embodiments, the cross section may be triangular, D-shaped, pentagonal, hexagonal, etc.

In other embodiments of the invention, the position of support leg 30 may be switched with the position of sleeve 18 so that tray 12 is connected to sleeve 18. In this embodiment, the latching mechanism may or may not change positions depending on the location of the slots.

The outer surface of sidewall 32 defines a plurality of spaced slots 34 that extend entirely across the width of sidewall 32. Each slot 34 is defined by walls disposed at right angles with respect to each other in order to increase the holding power of slots 34 with respect to ratchet mechanism 14.

Figure 7:
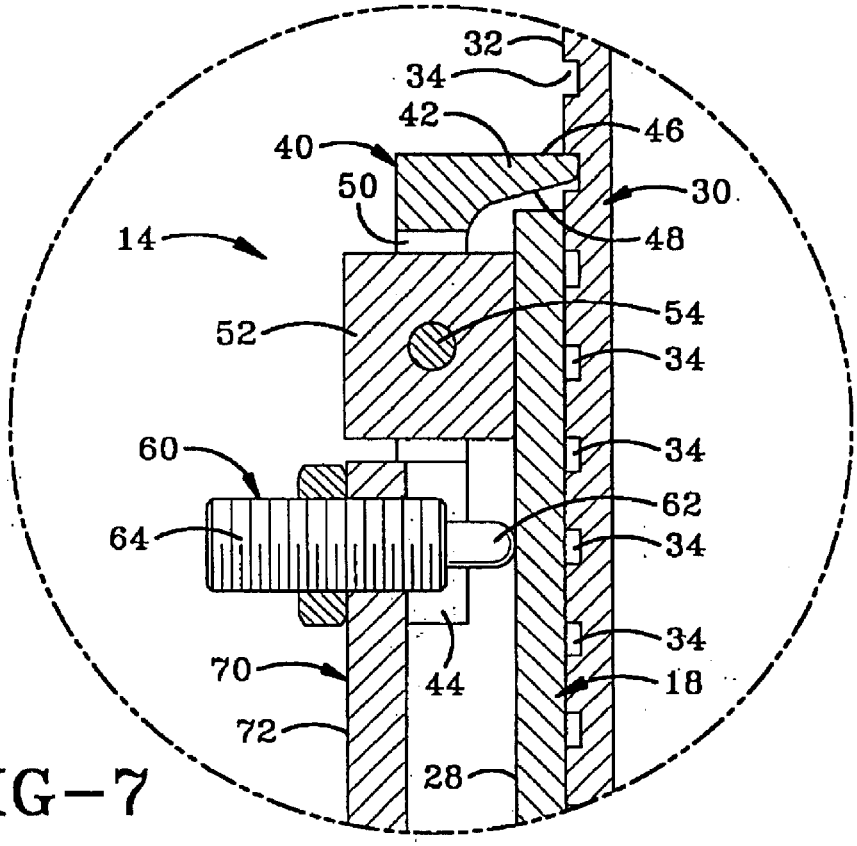
FIG. 7 is an enlarged section view of the ratchet mechanism in a locked position.
Figure 9:
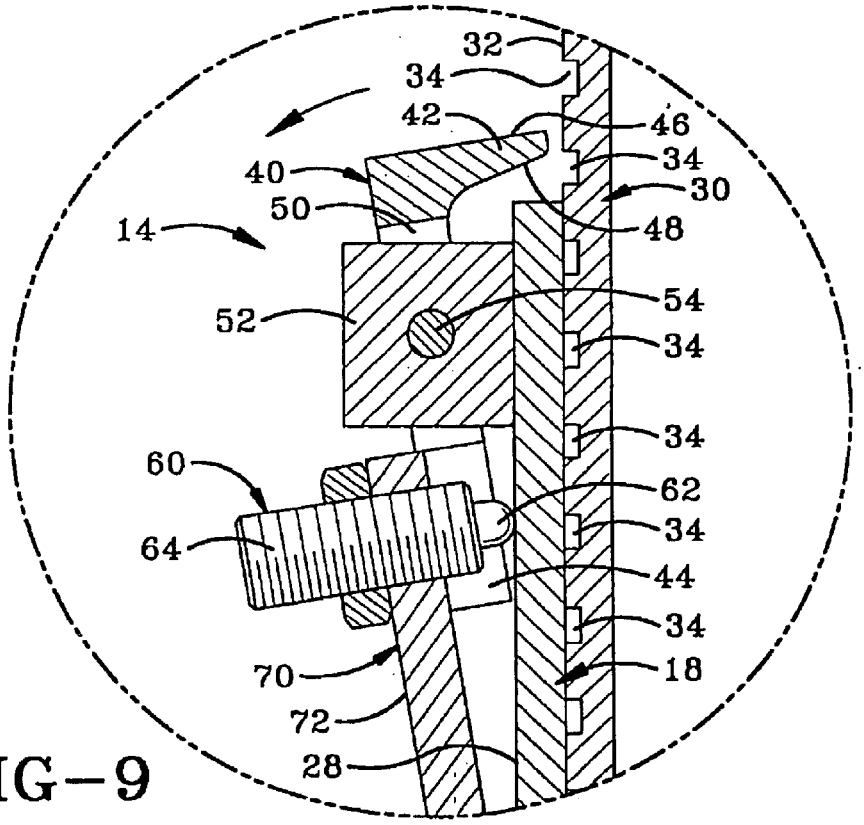
FIG. 9 is an enlarged section view of the ratchet mechanism in the unlocked position.

Ratchet mechanism 14 includes a locking detent 40 having a first portion 42 and a second portion 44. Detent 40 is adapted to be selectively positioned in slots 34 to lock the position of leg 30 with respect to sleeve 18. As shown in FIGS. 7 and 9, first portion 42 of detent 40 includes a flat upper surface 46 that provides the strong holding power of ratchet mechanism 14 and a sloped or angled lower surface 48 that allows tray 12 to be lifted without disengaging detent 40 from leg 30. First portion 42 has a width that is substantially the same as the width of slots 34 to create a strong, stable, and secure holding force.

First portion 42 is disposed substantially perpendicular to second portion 44. Second portion 44 defines an opening 50 that allows second portion 44 to be received over a boss 52 projecting from sleeve 18. A pivot pin 54 passes through second portion 44 and boss 52 to define the pivot axis of second portion 44.

A biasing mechanism 60 is carried by second portion 44 and acts against sleeve 18 to force detent 40 to its locked position. Biasing mechanism 60 is adjustable with respect to second portion 44 or detent 40. Mechanism 60 includes a threaded outer surface that threadedly engages a threaded opening defined by second portion 44. Rotation of mechanism 40 with respect to second portion 44 thus adjusts the position of mechanism 60 with respect to second portion 44. Mechanism further includes a head 62 that is slidably carried by the base 64 of mechanism 60. A spring is disposed between head 62 and base 64 to urge head 64 outwardly. The spring is designed to be strong enough to move detent 40 back to its locked position from an unlocked position without help from the user. Thus, if the user releases detent 40, biasing mechanism 60 will force detent 40 back to the locked position.

Biasing mechanism 60 is disposed below the pivot axis of detent 40. This position creates a lever that helps hold detent 40 in its locked position. The length of the lever arms may be adjusted as required to generate the desired amount of locking force for detent 40.

Other types of biasing mechanisms may also be used with detent 40. For example, biasing mechanism 60 may include a spring carried by sleeve 18 that forces detent 40 back to its locked position. One alternative spring is a leaf spring that may be attached to detent 40 of sleeve 18.

A handle 70 is connected to detent 40 and allows the user of table 10 to easily manipulate detent 40. Handle 70 projects down from detent 40 toward base 16. Handle 70 is elongated so that it may be easily found by the user of table 10. In one embodiment, handle 70 is at least half of the length of sleeve 18 and may be over ¾ the length of sleeve 18. This length allows handle to be manipulated by the leg of the user. Such a configuration allows handle 70 to be manipulated while the user holds tray 12 with both hands.

Figure 4:
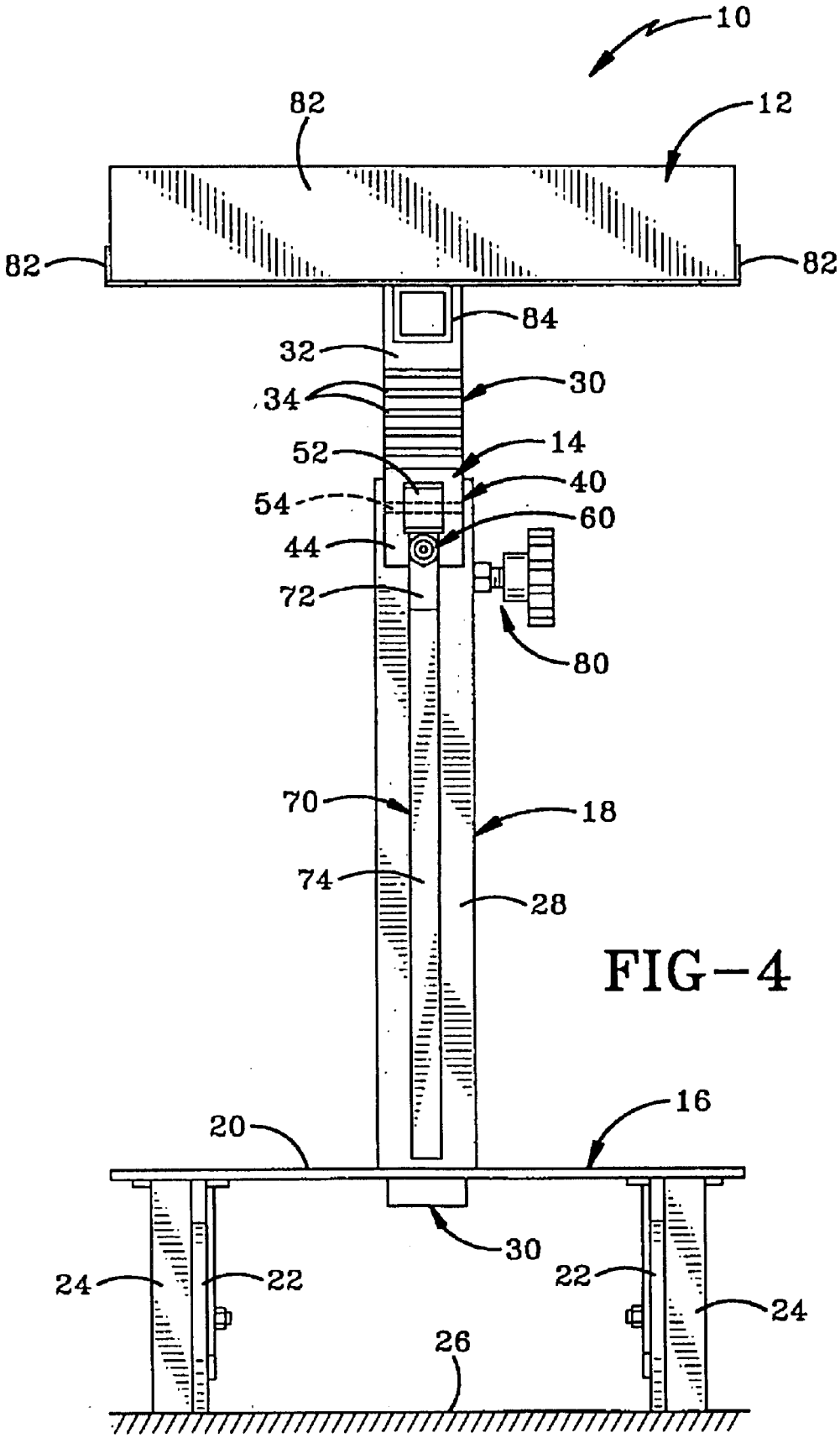
FIG. 4 is a front elevation view of the table.
Figure 5:
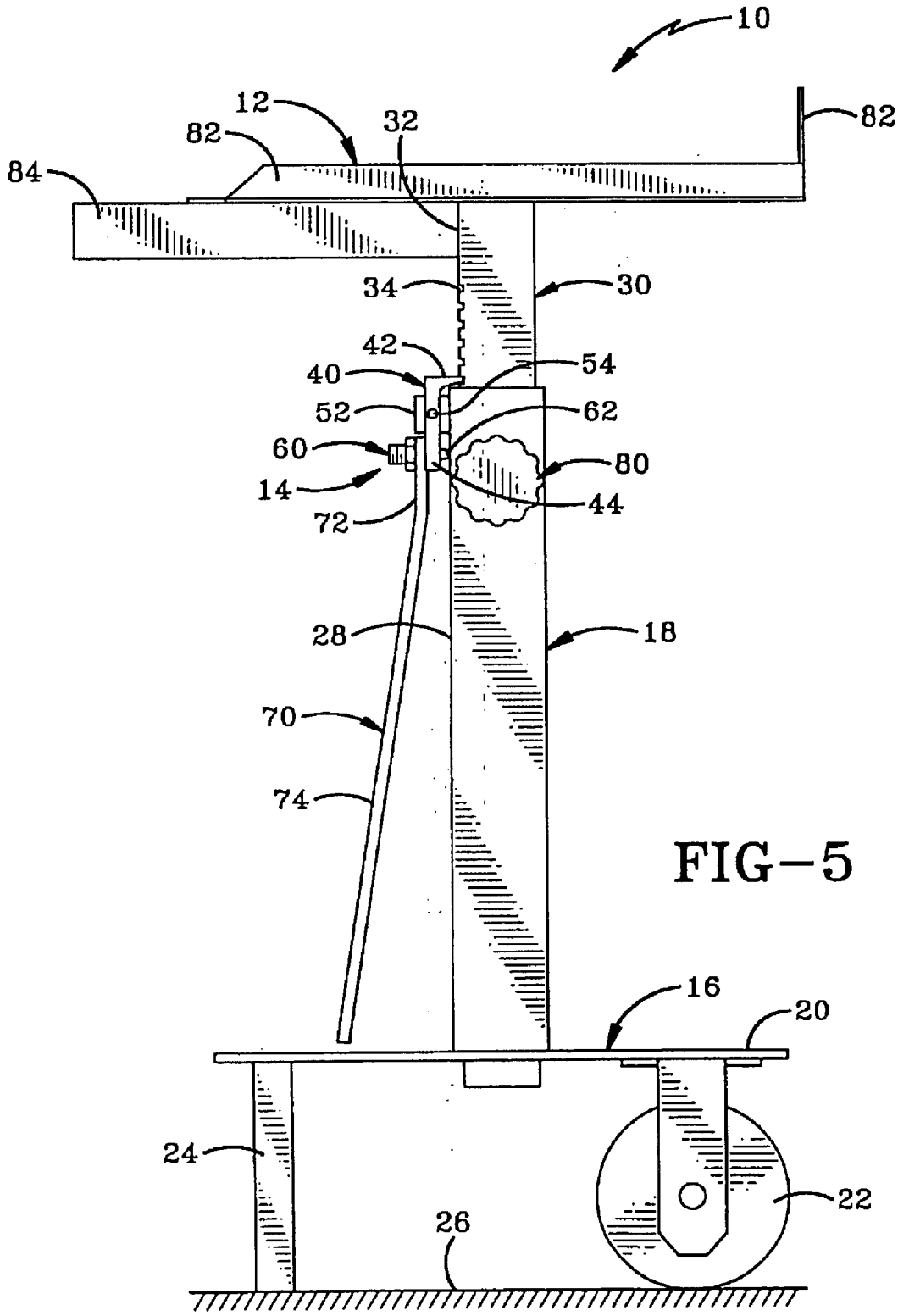
FIG. 5 is a side elevation view of the table.
Figure 6:
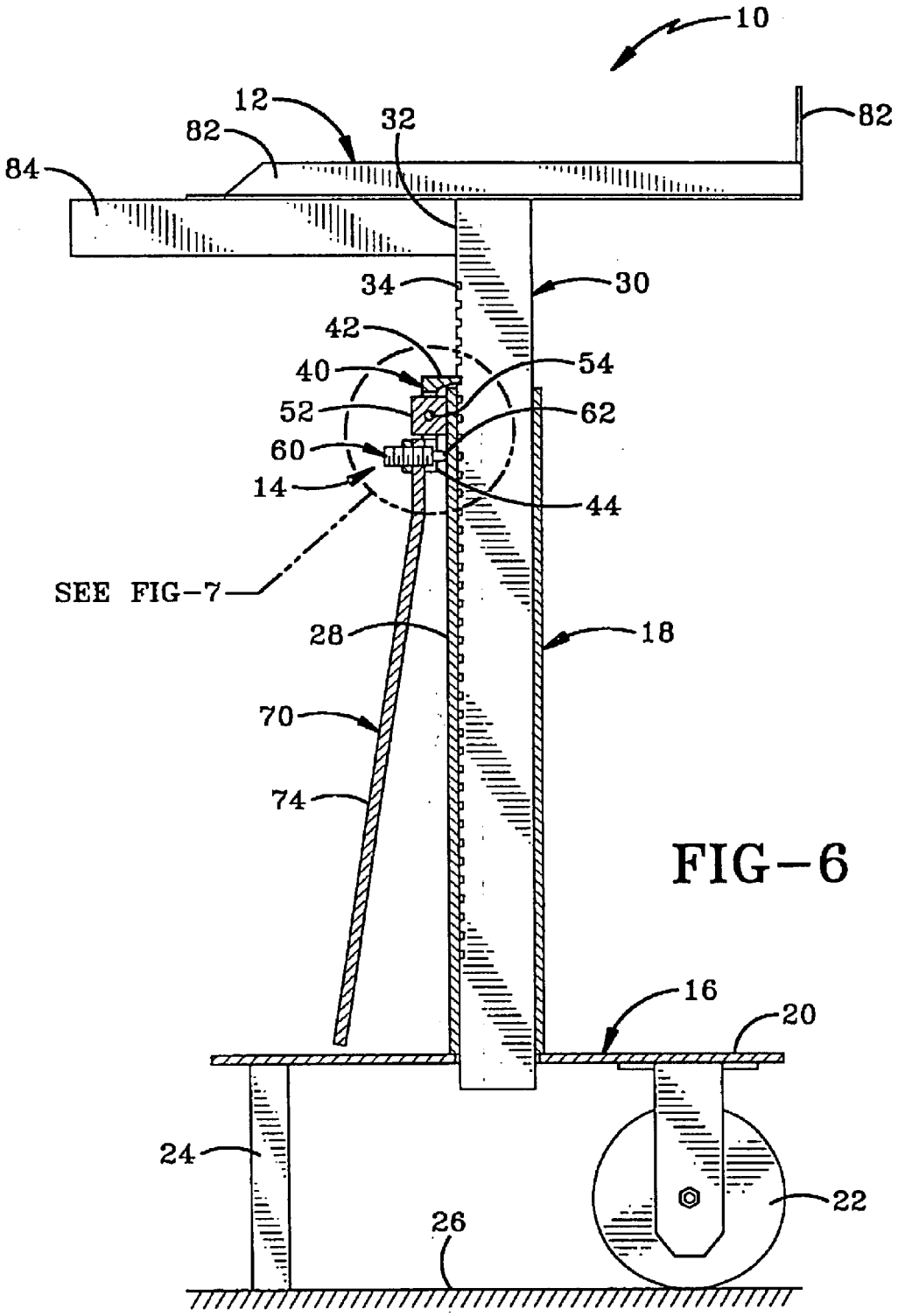
FIG. 6 is a side view, partially in section, of the table in a first position with the tray locked in position.
Figure 8:
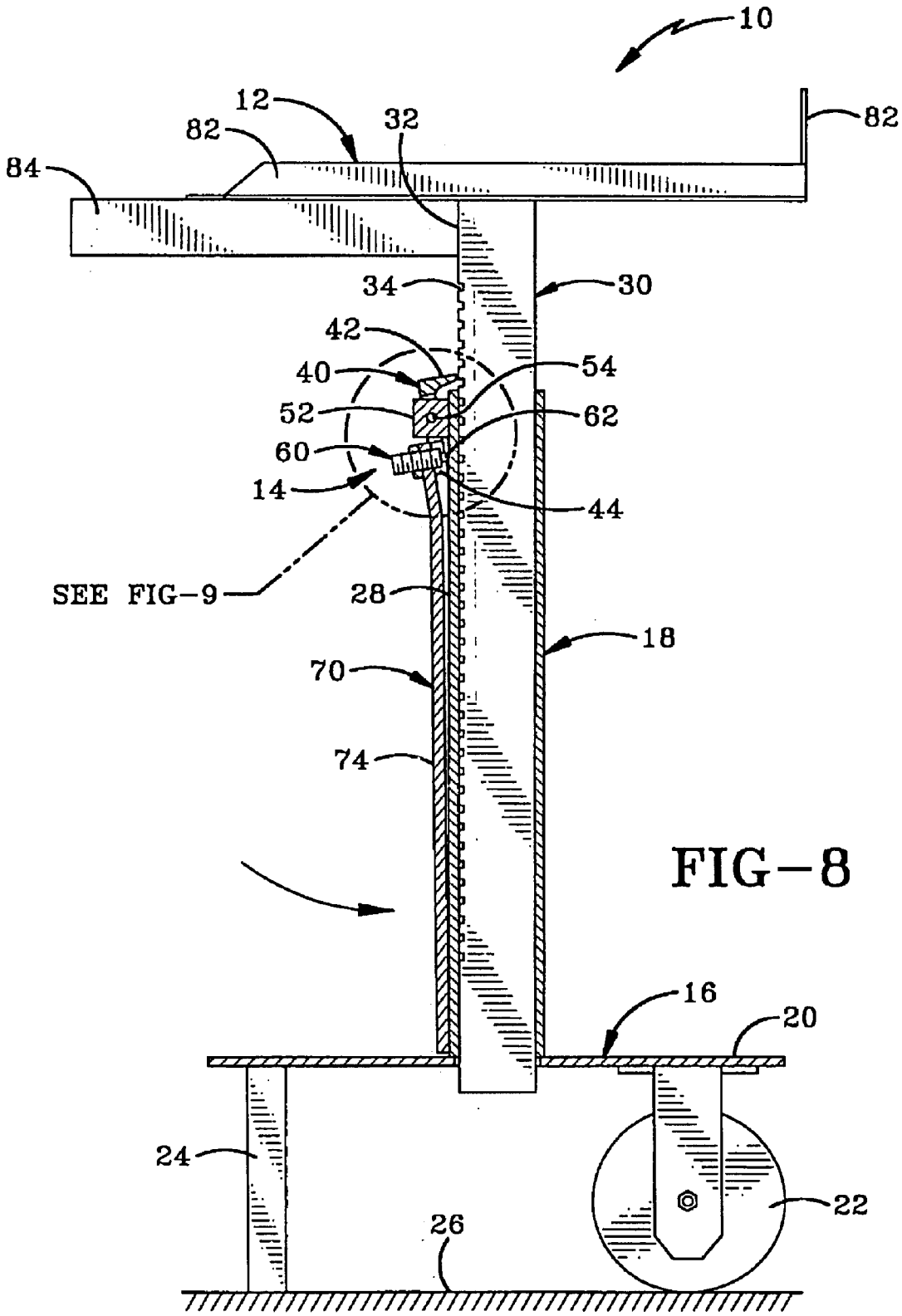
FIG. 8 is a side view, partially in section, of the table in the first position with the ratchet in the unlocked position.

Handle 70 includes first 72 and second 74 portions that are disposed at a non-zero angle with respect to each other. First portion 72 is connected to second portion 44 of detent 40 and biasing mechanism 60 may pass through the end of first portion 72. Handle 70 is generally parallel to sleeve 18 when viewed from the front as shown in FIG. 4. Handle 70 is configured to position second portion 74 angled away from sleeve 18 when detent is in the locked position of FIG. 5. Handle 70 is further configured to angle second portion 74 toward sleeve 18 when detent 40 is unlocked as shown in FIG. 8. These positions have been found to allow the user to easily manipulate detent 40 while adjusting table 10.

A secondary lock mechanism 80 may be provided to lock leg 30 and sleeve 18 together after the position of leg 30 has been selected. Mechanism 80 provides a safety feature that prevents tray 12 from falling if handle 70 is accidently engaged.

Tray 12 may be provided in many different variations with an exemplary variation shown in the drawings. Tray 12 may be a simply flat surface or may include the walls 82 shown in the drawings. Tray 12 may also include a beam 84 that strengthens tray 12.

Figure 10:
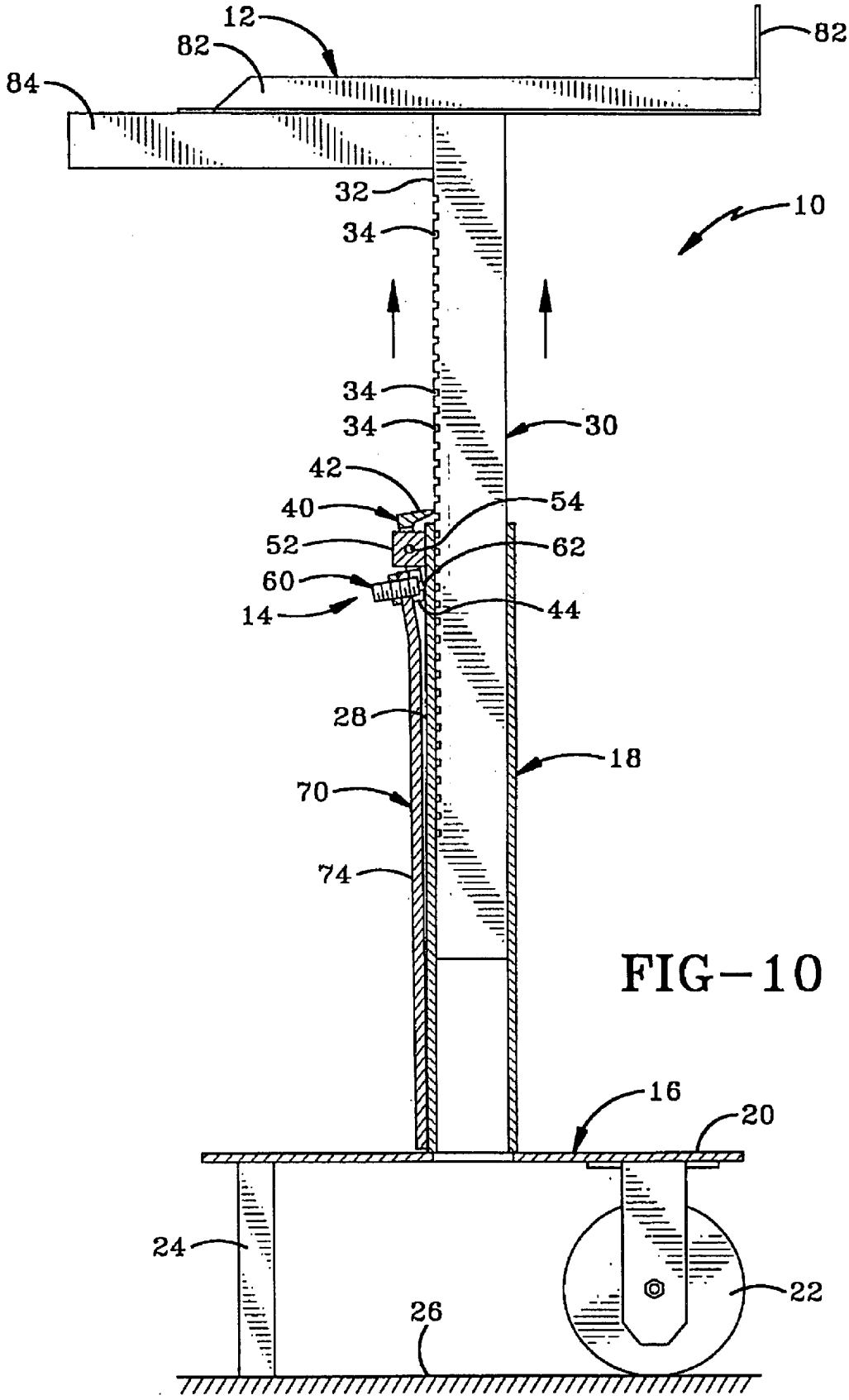
FIG. 10 is a side view, partially in section, of the table with the tray being moved to a second position with the ratchet in the unlocked position.
Figure 11:
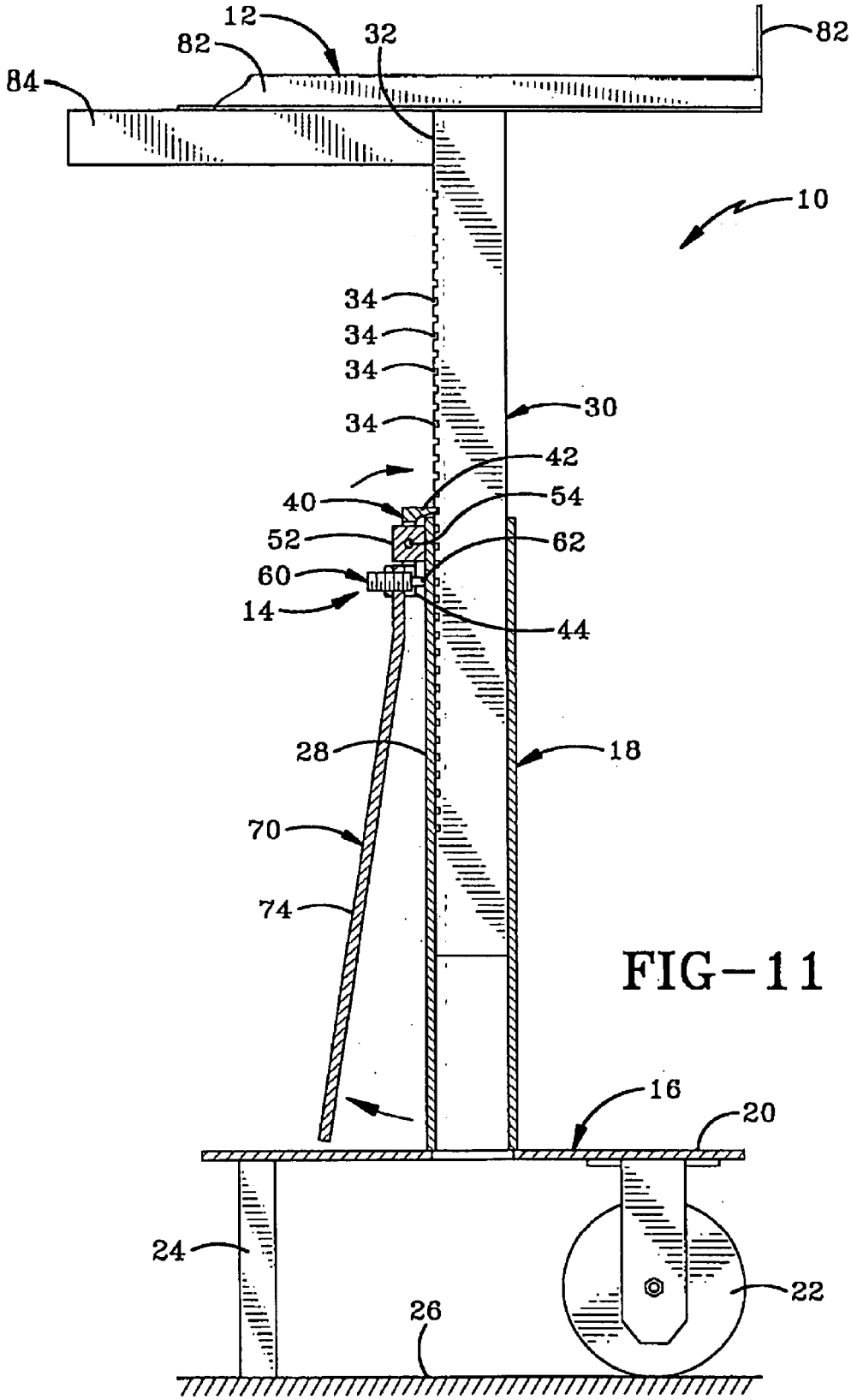
FIG. 11 is a side view, partially in section, of the table with the tray in the second position with the ratchet in the locked position.

The height of tray 12 with respect to base 16 may be adjusted simply by lifting tray 12 upwardly causing the bottom surface that defines each slot to move detent 40 to the unlocked position by interacting wall 48. The user may also move handle 70 to the unlocked position shown in FIG. 10 to adjust tray 12. When handle 70 is in the unlocked position, tray 12 may be moved up or down with respect to base 16.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A table comprising:

a base;

a tray;

a support leg having a sidewall that defines an outer surface having a width;

a support sleeve;

the support leg connected to one of the base and tray with the support sleeve connected to the other of the base and tray;

a portion of the support leg being received within a portion of the support sleeve;

the support leg being selectively slidable with respect to the support sleeve;

the outer surface of the support leg sidewall defining a plurality of slots; each of the slots extending entirely across the width of the outer surface;

a ratchet mechanism carried by the support sleeve;

the ratchet mechanism including a locking detent that is movable between locked and unlocked positions; the locking detent engaging one of the slots when the locking detent is in the locked position;

the locking detent having a width substantially equal to the width of the outer surface of the sidewall of the support leg;

biasing means for urging the locking detent toward the locked position; the biasing means being carried by the locking detent.

2. The table of claim 1, wherein the biasing means includes a spring disposed between the locking detent and the support sleeve.

3. The table of claim 1, wherein the position of the biasing means is adjustable with respect to the detent.

4. The table of claim 1, wherein the locking detent pivots with respect to the support sleeve at a pivot axis.

5. The table of claim 4, wherein the pivot axis is disposed intermediate the locking detent and the biasing means.

6. The table of claim 1, further comprising a handle connected to locking detent.

7. The table of claim 6, wherein the handle extends toward base from locking detent.

8. The table of claim 7, wherein the handle is substantially parallel to the support sleeve in one reference plane.

9. The table of claim 7, wherein the handle includes first and second portions; the first portion being connected to the locking detent; the second portion connected to the first portion and extending toward the base.

10. The table of claim 9, wherein the second portion of the handle is angled away from the support sleeve when the locking detent is in the locked position.

11. The table of claim 10, wherein the second portion of the handle is angled toward the support sleeve when the locking detent is in the unlocked position.

12. The table of claim 1, wherein the support leg has a rectangular cross section.

13. The table of claim 12, wherein the support leg has a square cross section.

14. A table comprising:

a base;

a tray;

a support leg connected to the tray; the support leg having a sidewall that defines an outer surface having a width;

a support sleeve connected to the base; the support sleeve having an upper end that defines an opening that receives the support leg;

a portion of the support leg being received within a portion of the support sleeve;

the support leg being selectively slidable with respect to the support sleeve;

the outer surface of the support leg sidewall defining a plurality of slots;

a ratchet mechanism carried by the support sleeve;

the ratchet mechanism including a locking detent that is movable between locked and unlocked positions;

the locking detent engaging one of the slots when the locking detent is in the locked position;

the engagement between the locking detent and the slot being located above the upper end of the sleeve such that the user of the table can visually confirm the locked position of the locking detent; and a biasing element carried by the locking detent and engaging the sleeve; the biasing element urging the locking detent toward the locked position.

15. A table comprising:

a base;

a tray;

a support leg connected to the tray; the support leg having a sidewall that defines an outer surface having a maximum width;

a support sleeve connected to the base; the support sleeve having an upper end that defines an opening that receives the support leg;

the support leg and support sleeve having rectangular cross sections;

a portion of the support leg being received within a portion of the support sleeve;

the support leg being selectively slidable with respect to the support sleeve;

the outer surface of the support leg sidewall defining a plurality of slots; each of the slots extending entirely across the maximum width of the support sleeve;

a ratchet mechanism carried by the support sleeve;

the ratchet mechanism including a locking detent that is movable between locked and unlocked positions; the locking detent having a width substantially equal to the slots;

the locking detent engaging one of the slots when the locking detent is in the locked position;

the engagement between the locking detent and the slot being located above the upper end of the sleeve such that the user of the table can visually confirm the locked position of the locking detent;

a handle connected to the locking detent; the length of the elongated handle being over hall of the length of the support sleeve;

a biasing element carried by the locking detent and engaging the sleeve; the biasing element urging the locking detent toward the locked position; the position of the biasing element being adjustable with respect to the detent; a portion of the biasing element extending through a portion of the handle; and a secondary locking mechanism carried by the support sleeve between locked and unlocked positions; the locked position of the secondary locking mechanism locking the position of the support leg with respect to the support sleeve.

* * * * *